US005340432A

United States Patent [19]

Schulz et al.

[11] Patent Number: 5,340,432

[45] Date of Patent: Aug. 23, 1994

[54] SINGLE-FACE STATION FOR A MACHINE THAT PRODUCES CORRUGATED CARDBOARD

[75] Inventors: Jens Schulz, Hamburg; Martin Hoffmann, Tangstedt, both of Fed. Rep. of Germany; Jean-Claude Rebeaud, Le Mont, Switzerland

[73] Assignee: Peters Maschinenfabrik, Hamburg, Fed. Rep. of Germany

[21] Appl. No.: 78,045

[22] Filed: Jun. 18, 1993

[30] Foreign Application Priority Data

Jun. 19, 1992 [CH] Switzerland ..... 01936/92

[51] Int. Cl.[5] ..... B31F 1/28

[52] U.S. Cl. ..... 156/472; 156/471; 156/210

[58] Field of Search ..... 156/472, 471, 470, 205, 156/210, 473, 553; 425/336, 369; 493/463

[56] References Cited

U.S. PATENT DOCUMENTS

| | | | |
|---|---|---|---|
| 3,455,767 | 7/1969 | Meister | 156/473 |
| 4,569,714 | 2/1986 | Tokuno | 156/471 |
| 4,629,526 | 12/1986 | Kanda | 156/210 |
| 4,631,109 | 12/1986 | Hirakawa et al. | 156/472 |
| 4,642,087 | 2/1987 | Hoffmann | 156/205 |
| 4,643,706 | 2/1987 | Pohl et al. | 156/472 |
| 4,818,330 | 4/1989 | Mosburger | 156/473 |

FOREIGN PATENT DOCUMENTS

| | | |
|---|---|---|
| 0136510 | 4/1985 | European Pat. Off. . |
| 0144536 | 6/1985 | European Pat. Off. . |
| 0260526 | 3/1988 | European Pat. Off. . |

*Primary Examiner*—Michael W. Ball
*Assistant Examiner*—Michele K. Yoder
*Attorney, Agent, or Firm*—Hill, Steadman & Simpson

[57] ABSTRACT

A single-face station for a machine that produces corrugated cardboard comprises a frame which includes a stand with two lateral wall members, a lower cassette which carries a lower pressure roll being positioned on support and resting surfaces formed in the lateral walls, an upper cassette having a pair of corrugating rolls resting on the lower cassette and on guide surfaces in each of the side walls. The resting surface and support surface extend at right angles to each other and obliquely to a horizontal plane and the arrangement includes a holding arrangement to exert a downward force on anchoring points provided in a lower rear portion of the upper cassette in order to hold the upper cassette and lower cassette on their respective resting, supporting and guiding surfaces. In addition, there is an extracting arrangement for allowing the upper cassette to be withdrawn laterally from the frame.

7 Claims, 4 Drawing Sheets

SINGLE-FACE STATION FOR A MACHINE THAT PRODUCES CORRUGATED CARDBOARD

BACKGROUND OF THE INVENTION

The present invention is directed to a single-face station for a machine which produces corrugated cardboard sheets, which machine includes a frame which has a stand with two lateral wall members between which are installed a lower pressure roll and an upper cassette that carries a pair of superimposed corrugating rolls.

The single-face station is usually located upstream of a machine that produces corrugated cardboard. In such a station, a first web of paper is corrugated when travelling between an upper corrugating roll and a lower corrugating roll. A glue application roll is located almost at the level of the lower corrugating roll and will apply the glue on the crest of the corrugated sheet prior to the application of a second covering sheet, such as paper, by means of the pressure roll located under the lower corrugating roll.

On most of the current machines of small and medium dimensions, the rolls are simply arranged on bearings that are permanently fixed or mounted in the frame of the station. However, it is also sometimes necessary to take out the corrugating rolls for maintenance and repair. It is also useful to have the possibility of taking out the same rolls to exchange them in order to modify the flute profile and adapt it at best with regard to the flute required for the corrugated board to be produced. However, the dismantling operation for the corrugating rolls arranged on bearings that are permanently fixed is difficult and time-consuming because it requires a tilting of the massive upper crossbar around a lower hinge in order to obtain access to these rolls and to their bearings. It also involves uncoupling of the various connections of the drive motors and of the ducts delivering steam to the corrugating rolls, and then the undoing of the anchoring points of the bearings in order to take out the rolls to be exchanged and to bring the next rolls to their operating position.

In consideration of the above-mentioned difficulties, cassettes for carrying the pair of corrugating rolls with their bearings and drive motors have now been manufactured for machines of larger dimensions. These cassettes can be taken out laterally when rolled on rails permanently fixed on the frame, as well as onto rails belonging to a carriage. It is also known for a particularly large-dimensioned machine in which the cassette can be fitted in an upper space of the frame in order to lower a second cassette according to an orthogonal direction, which action then allows a very quick exchange of the corrugating rolls and, hence, a change of the flute profile. Every cassette can also be taken out laterally for the exchange of the corrugating rolls or for their maintenance.

However, up to now, this cassette system has only been applicable to machines with massive frames. In fact, the large dimensions of the cassettes and the importance of the forces, that are applied to the frame, have required an overdimensioning of the framework making up the lateral wall members of the frame.

SUMMARY OF THE INVENTION

It is an object of the present invention to provide a single-face station with cassettes which would be compact and whose conception would allow for a simple construction in order to lower the manufacturing cost. The conception of the structure should be such that the way of arranging and fixing the cassette is quick and strong and preserves, at the same time, sufficient space for the access to and maintenance of all components. Moreover, and as usual, the operation of the machine should be reliable, efficient for a quality production of corrugated cardboard and, at the same time, as light-operable with vibratory conditions on the station as weak as possible.

To accomplish these goals, the present invention is directed to an improvement in a single-face station for a machine that produces corrugated cardboard, said station including a frame which includes a stand with two lateral wall members, a lower pressure roll and an upper cassette that carries a pair of superimposed corrugating rolls being installed in the frame between the wall members. The improvement comprises the fact that the lower pressure roll is installed in a lower cassette on a resting surface and a supporting surface that are orthogonally arranged opposite one another in the front edge of both the lateral wall members and that the supporting surface is orientated obliquely with regard to the horizon, the upper cassette resting on upper side edges of the lower cassette, as well as on the guiding surface extending parallel to the supporting surface and almost in the same plane as the one defined by the supporting surface, said guiding surfaces being also arranged opposite one another in the front edge of every lateral wall, said upper cassette and frame having means for extracting the cassette from the lateral walls and holding means exerts a downward traction on the anchoring points situated adjacent the rear surface of the upper cassette in order to keep the lower cassette and upper cassette on their respective resting, supporting and guiding surfaces.

Owing to this arrangement, access to the corrugating rolls from the front part of the machine is particularly simplified. Above all, the distribution of forces in their lines of action, which concentrate on the bottom front part of the frame are mastered.

A traction or torsion exerted downward by the holding means interlocks simultaneously and in a coordinated manner the cassettes carrying the pressure roll and the corrugating rolls. The acting and counteracting forces are judiciously distributed along the separating planes between the cassettes and/or the supporting surfaces of the frame.

Advantageously, the cassettes are conceived in such a way that the supporting surfaces for the lower cassette and the guiding surfaces of the upper cassette extend in two planes orientated obliquely and offset one with regard to the other.

More specifically, the supporting surfaces of the lower cassette and the guiding surfaces of the upper cassette are orientated obliquely according to an angle contained between 40° and 85° with regard to a horizontal plane.

Advantageously, the supporting surfaces of the lower cassette and the guiding surfaces of the upper cassette are orientated obliquely according to angle of 60° with regard to the horizontal plane.

Owing to this fact, a large part of the forces exerted by the action of the holding means will be distributed in a balanced manner. The angle of 60° is an excellent compromise between the two contradictory problems, which are the inherent flexing of the rolls because of their own weight and the minimization of the vibrations in the operating conditions.

Advantageously, the holding means of the upper cassette and of the lower cassette on their resting, supporting and guiding surfaces consist of a pair of hydraulic jacks arranged on either side of the lateral wall members of the frame. Each jack is orientated obliquely toward the upper and lower and cassette. Usefully, the hydraulic jacks are orientated obliquely according to the angle of approximately 10° with regard to the vertical toward the upper and lower cassettes. The setting into operation of a hydraulic jack is particularly quick by the fact that it only requires the coupling of its sliding rod on the anchoring point adjacent the rear surface of the first cassette and the application of the hydraulic pressure. Moreover, it is possible to modify at any time the traction force being exerted by the jack, and this is because of the temporary operating conditions of the machine, in order, for instance, to adjust the pressure for the application of the covering paper and/or to minimize the vibrations.

The upper cassette rests on its upper rear surface. By means of rollers on a crossbar of the frame and its lower front edge also being equipped with rollers which cooperate with a cross rail connected to the frame, the cassette can be laterally extracted from the frame by means of a translation movement.

Other advantages and features of the invention will be readily apparent from the following description of the preferred embodiments, the drawings and claims.

DESCRIPTION OF THE PREFERRED EMBODIMENTS

Figure 1:
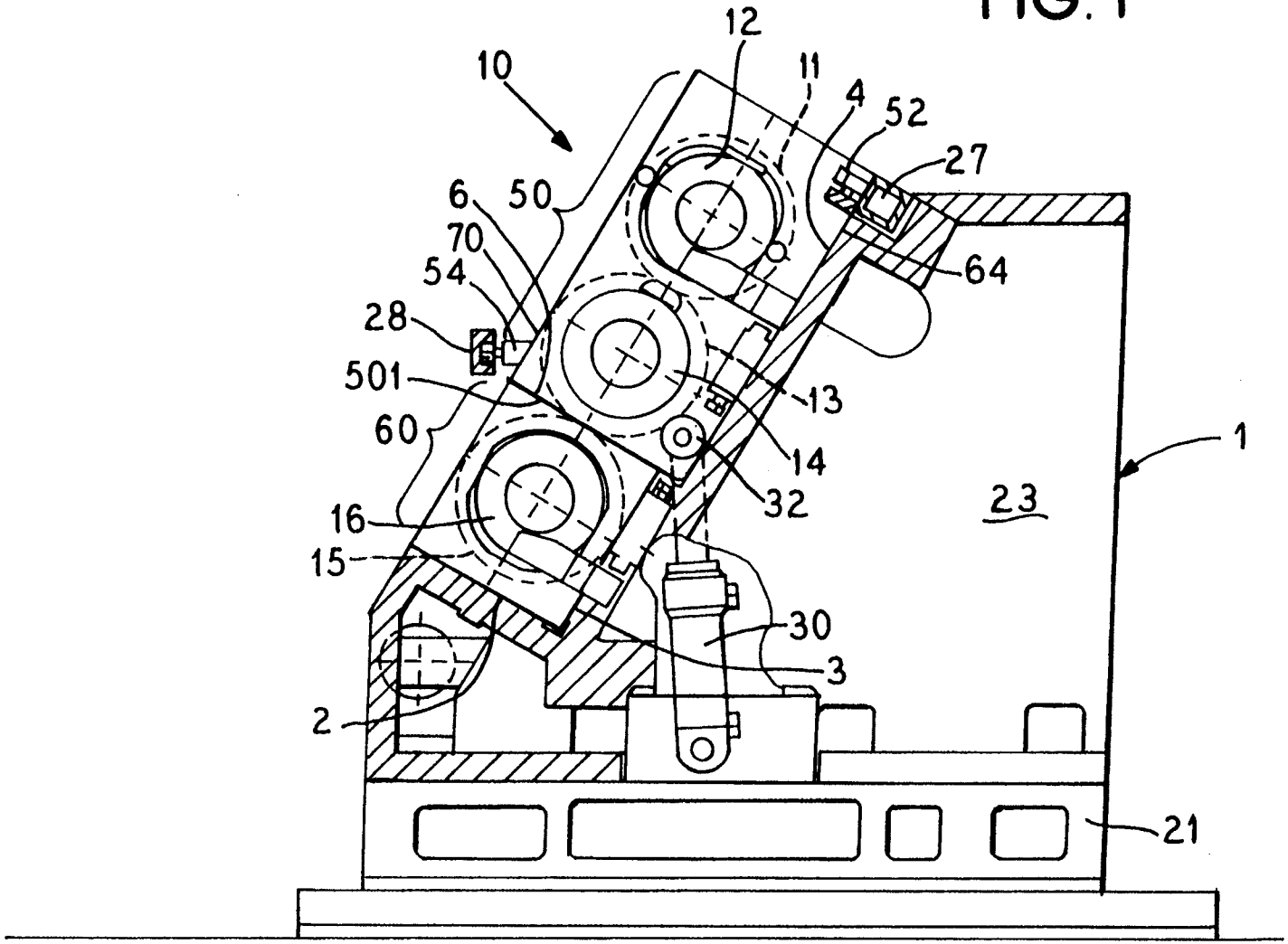
FIG. 1 is a side view with portions broken away of a single-face station in accordance with the present invention.

The principles of the present invention are particularly useful when incorporated in a single-face station, generally indicated at 10 in FIG. 1. The single-face station 10 has a frame 1 which includes a stand 21 with two lateral walls or side members 23, which are interconnected by cross members or crossbars, such as 27. The upper corrugating roll 11 and its drive motor 12 and the lower corrugating roll 13 and its drive motor 14, as well as the respective bearings, are arranged in an upper cassette 50. In this upper cassette 50, the lower corrugating roll 13 has a fixed reference position, whereas the position of the upper corrugating roll 11 and its bearings can be adjusted and/or pushed in an elastic way on or against the lower corrugating roll 13.

More specifically, according to the present invention, a lower pressure roll 15 and its motor 16 and bearings are arranged in a lower cassette 60, which allows for the adjustment of the position according to the axis of the cassette. This lower cassette 60 and the upper cassette 50 are then piled one above the other on a seat which is arranged in the front edge of the lateral walls 23, and this seat is orientated almost toward the inside of the frame.

More specifically, the seat consists of a resting surface 2 and a supporting surface 3 that are arranged orthogonally opposite one another in the front edge of both lateral walls 23 in order to take up the lower cassette 60. The seat also includes a guiding surface 4 which extends parallel to the supporting surface of the lower cassette 60 in order to take up or support portions of the upper cassette 50. It should be mentioned that on the representation made in the Figures, the supporting surface 3 and the guiding surface 4 extend in two different planes. It could easily be imagined that the supporting surface 3 and the guiding surface 4 are situated in the same plane by dimensioning the lower cassette 60 accordingly.

The supporting surface 3 and the guiding surface 4 are orientated to extend obliquely with regard to the horizontal according to an angle contained within a range of 40° to 85°. According to the plant test of the invention, it is found that the preferred angle is 60° and the resting surface 2 then makes up an angle of 30° with regard to the horizontal. All the lower pressure roll 15, the lower corrugating roll 13 and upper corrugating roll 11 are aligned with their axes falling in the same plane extending parallel to the supporting surface 3 and the guiding surface 4.

In short, the upper cassette 50 lies with its lower side edges 501 on an upper side edge 6 of the lower cassette 60, which is supported on the resting surface 2. The upper cassette 50 and the lower cassette 60 also lie on the supporting surface 3 and the guiding surface 4, respectively, in the front parts of both the lateral wall members 23.

Another characteristic particularly original to the present invention remains in the way of keeping the upper cassette 50 and the lower cassette 60 in the seat consisting of the resting, supporting and guiding surfaces 2, 3 and 4 only by means of a pair of hydraulic jacks or pneumatic cylinders 30 that are orientated obliquely toward the seating surfaces of the cassette, as well as arranged close to an outer surface of the wall members 23. The jacks act in traction between the stand 21 and an anchoring point 32, which is situated in the lower rear part of each end of the upper cassette 50. This traction or tension force achieved by the pneumatic cylinder 30 causes an interlocking of the lower cassette 60, which is then locked between the resting surface 2 and the lower side edges 501 of the upper cassette 50. This traction force interlocks simultaneously the upper cassette 50 on the upper side edges 6 of the lower cassette 60 and on the guiding surface 4. As may be easily gathered from the Figures, the lower portion of the anchoring point 32 on this upper cassette 50 keeps the cassette 50 from tilting around its lower front edge. All of the necessary holding forces are regularly distributed at the level of the resting surface 2, the supporting surface 3 and the guiding surface 4, which make up the seat, and it becomes unnecessary to add any other elements to the upper framework or gantry, although this has initially, and until now, been considered as required in previously-known devices.

Advantageously, the line of action of the pneumatic jack 30 is not exactly vertical but orientated by 10° toward the outside of the frame 1 of the station 10, i.e., in the direction of the lower cassette 60 and the upper cassette 50.

As illustrated in FIG. 1, the upper edge of the rear side surface 64 of the cassette 50 is provided with a retractable roller 52 which rests on the crossbar 27 of the frame 1. Diagonally to the cassette, i.e., at a lower edge of a front side surface 70 of the upper cassette 50, rollers 54 are mounted in order to cooperate with a cross rail 28 also connected to the frame 1. After the uncoupling of the anchoring points 32, it is then possible to take the cassette 50 laterally out of the frame with a simple translational movement onto rails, which is not represented, which will belong to an evacuation carriage, which is also not illustrated, but which is positioned at the desired spot opposite the upper cassette 50.

Figure 2:
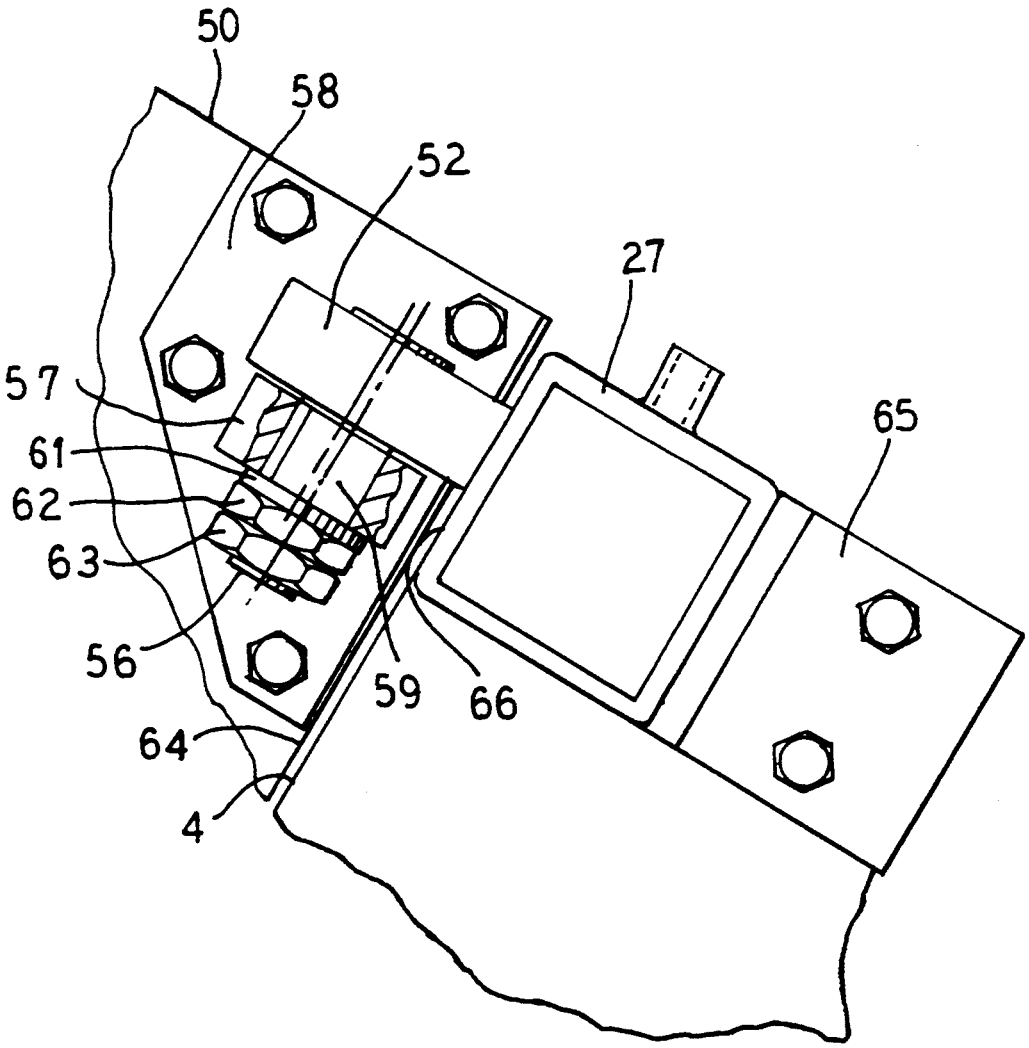
FIG. 2 is an enlarged detail view with portions broken away for purposes of illustration of one of the rollers of the upper part of the upper cassette.

The roller 52 of the upper part of the upper cassette 50 is shown in greater detail in FIG. 2. The roller 52 is mounted on a trunnion 56, whose cylindrical eccentric part 59 is engaged in a bore machined in a block or cramp 57 of a support 58, which is held on the side of the upper cassette 50 by screws. The trunnion 56 is secured in the cramp 57 by means of a washer 61, a nut 62 and a counter-nut 63. When the cassette of the single-face station 10 is to be taken out, this arrangement allows the trunnion 56 rotate so that under the effect of the eccentric portion of the cylindrical eccentric part 59, the roller 52 will act on the crossbar 57 and push the rear side surface 64 of the upper cassette 50 away from the guiding surface 4 and therewith allow the rolling of the upper cassette 50 on the crossbar 27 without any rubbing effect between the rear side surface 64 of the cassette 50 and the guiding surface 4. During the setting into operation of the upper cassette 50, the trunnion 56 will be retracted by a reverse rotation so as to have the rear side surface 64 of the upper cassette 50 come in contact with the guiding surface 4. We shall see further on that this action on the trunnion 56 will have to be executed at the same time or a little after the roller 54 of the front side surface of the upper cassette 50 has been set free from its centering means, which are arranged in the cross rail 28. As illustrated in FIG. 2, the crossbar 27 is fitted on a square piece 65, which is screwed onto the lateral wall member 23 in such a way that the rolling plane 66 of this crossbar 27 will be aligned in the same plane with the guiding surface 4.

Figure 3:
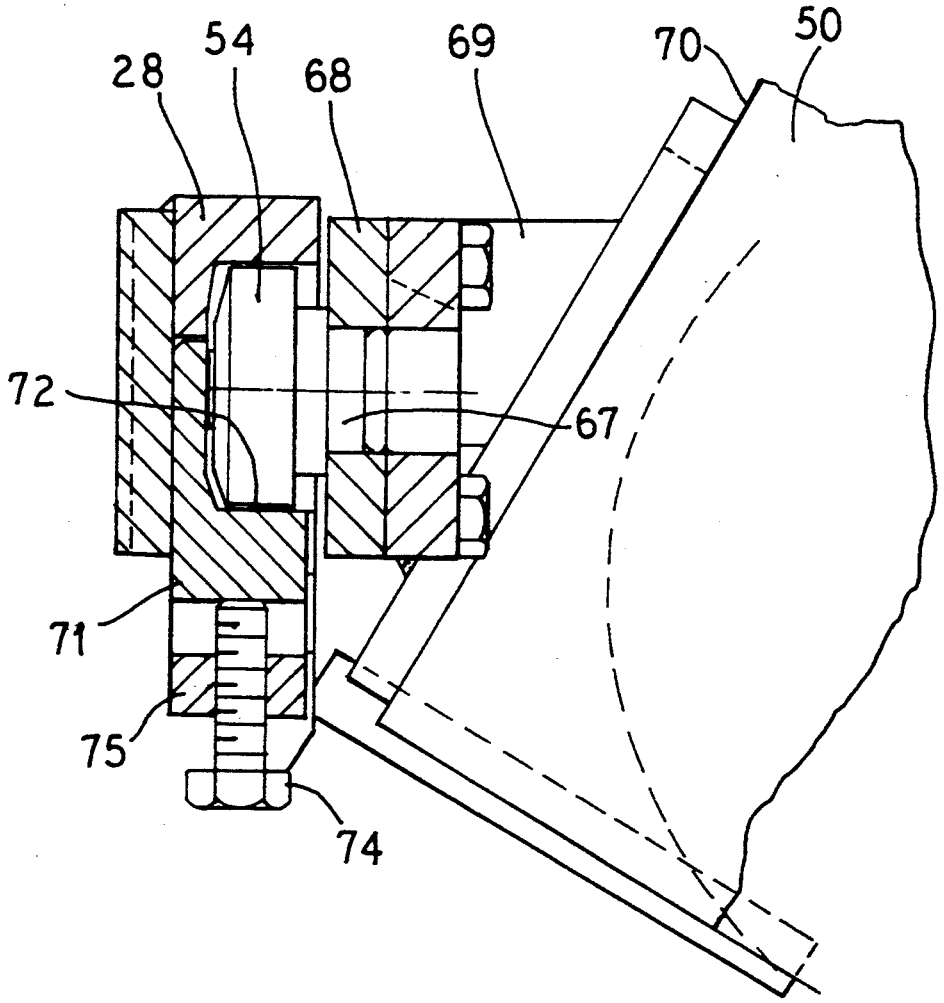
FIG. 3 is a cross sectional view with portions in elevation of one of the rollers on the lower part of the upper cassette.
Figure 4:
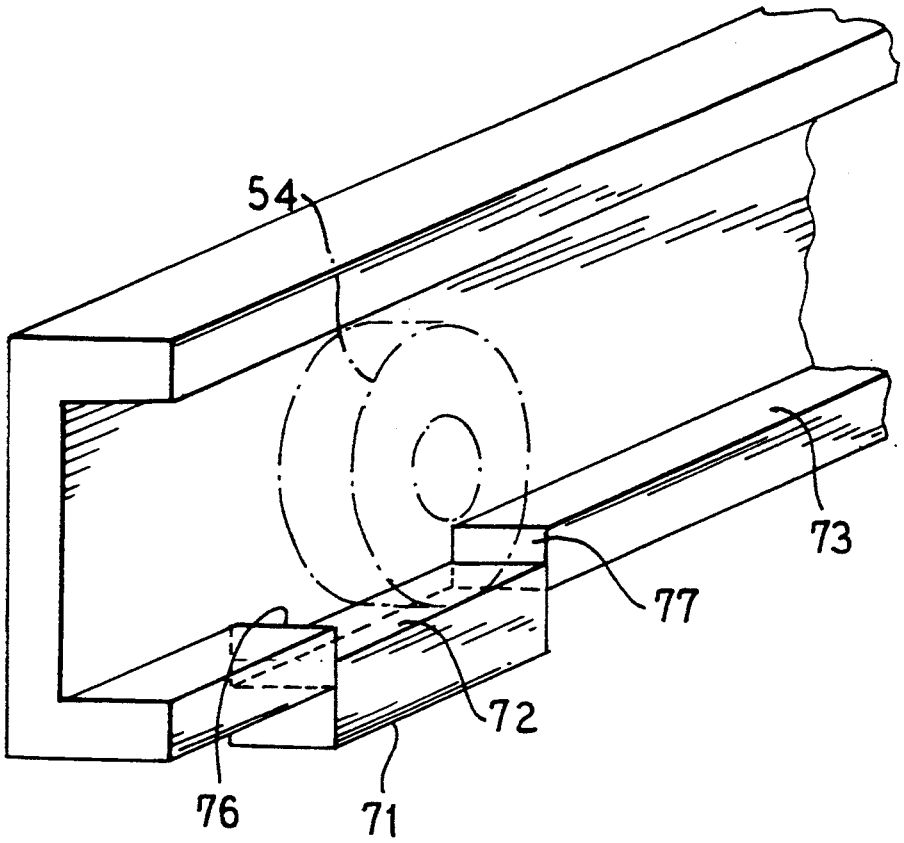
FIG. 4 is a perspective view of one end of a rail destined to guide the rollers of the lower part of the upper cassette.

The roller 54 of the lower part of the front side surface 70 of the upper cassette 50 is fitted on a trunnion or axle 67 (see FIG. 3), which is welded on a base piece 68. The base piece 68 is fastened to a support 69 by threaded fasteners, and the support 69 is secured by threaded fasteners onto the front side edge 70 of the upper cassette 50. During the extraction of the upper cassette 50, the roller 54 can slide in the rail 28, which is equipped with centering means consisting of a rail portion 71 (FIGS. 3 and 4). The rail portion 71 can be shifted so that a rolling surface 72 lies in a plane of the rolling surface 73 of the rail 28 to a position illustrated in FIG. 4, wherein the surface 72 is below the surface 73 to form steps or hips 76 and 77. The position illustrated in Fig. 4 is particularly taken when the holding means is actuated to lock the cassettes in the frame. The vertical movement of the rail portion 71 can be obtained by a screw 74 (Fig. 3), which is engaged in threads of a cramp 75 permanently mounted on the frame 1. The width of the rail portion 71 is defined in such a way that the circumference of the roller 54 will rest on the hips or steps 76 and 77 and that the upper cassette will, therefore, be centered laterally in its operating position, such as represented by the dashed lines in Fig. 4.

Although various minor modifications may be suggested by those versed in the art, it should be understood that we wish to embody within the scope of the patent granted hereon all such modifications as reasonably and properly come within the scope of our contribution to the art.

We claim:

1. In a single-face station for a machine for producing corrugated cardboard, said station including a frame, which includes a stand with two lateral wall members, a lower pressure roll being mounted in said frame between the wall members and an upper cassette carrying a pair of superimposed corrugating rolls, the improvements comprising the lower pressure roll being installed in a lower cassette, said lateral wall members of the frame having a resting surface and a supporting surface adjacent a front edge of each wall member, said supporting surface being orientated obliquely with regard to the horizontal plane, and the resting surface and supporting surface extending at right angles to each other, said lower cassette lying on the resting surface and engaging the supporting surface, said wall members of the frame having guiding surfaces extending parallel to the supporting surfaces, said upper cassette lying on upper side edges of the lower cassette and on the guiding surfaces, said upper cassette having anchoring points situated adjacent a rear side edge of the upper cassette, said frame and upper cassette having extracting means to enable removing the upper cassette laterally from the frame, and holding means engaging the anchoring points of the upper cassette and exerting a downward force on the upper cassette to keep the lower cassette and upper cassette on their respective resting, supporting and guiding surfaces.

2. In a single-face station according to claim 1, wherein the supporting surface and the guiding surface extend in two separate planes offset with regard to one another.

3. In a single-face station according to claim 1, wherein the supporting surface and the guiding surface are orientated obliquely at an angle in a range of 40° and 80° with regard to a horizontal plane.

4. In a single-face station according to claim 3, wherein the supporting surface and guiding surface are orientated obliquely at an angle of 60° relative to the horizontal plane.

5. In a single-face station according to claim 1, wherein the holding means for the upper cassette include a pair of hydraulic jacks arranged on either side of the lateral wall members of the frame, each jack being orientated obliquely toward the upper cassette and engaging an anchoring point on said upper cassette.

6. In a single-face station according to claim 5, wherein the hydraulic jacks are orientated obliquely toward the cassettes and form an angle of 10° with a vertical plane.

7. In a single-face station according to claim 1, wherein the extracting means include retractable rollers mounted on an upper rear edge of the upper cassette for engaging a cross member of the frame and rollers mounted on a lower front edge of the upper cassette to cooperate with a cross rail connected to the frame, said cross rail being equipped with means for laterally centering the upper cassette in the working position in the frame.

* * * * *